US006354234B2

(12) United States Patent
Wakasugi

(10) Patent No.: US 6,354,234 B2
(45) Date of Patent: Mar. 12, 2002

(54) SEWING MATERIAL HOLDING DEVICE AND SEWING MACHINE HAVING THE SAME

(75) Inventor: Kazuhisa Wakasugi, Obu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/808,148

(22) Filed: Mar. 15, 2001

(30) Foreign Application Priority Data

Mar. 15, 2000 (JP) ..... 2000-072925

(51) Int. Cl.[7] ..... D05C 9/04
(52) U.S. Cl. ..... 112/470.14; 112/103
(58) Field of Search ..... 112/103, 470.14, 112/148, 311; 38/102, 102.2, 102.91, 102.4

(56) References Cited

U.S. PATENT DOCUMENTS 4,419,945 A * 12/1983 Nishina ..... 112/103
4,644,881 A * 2/1987 Schmidt et al. ..... 112/103
5,129,171 A * 7/1992 Arbter et al. ..... 38/102.2

FOREIGN PATENT DOCUMENTS

JP 7-305257 11/1995
JP 8-041774 2/1996
JP 2000-42276 2/2000

* cited by examiner

*Primary Examiner*—Ismael Izaguirre
(74) *Attorney, Agent, or Firm*—Oblon, Spivak, McClelland, Maier & Neustadt, P.C.

(57) ABSTRACT

A sewing material holding device 2 in a sewing machine includes a first arm device 3R and a second arm device 3L and makes it possible to hold a sewing material 1 temporarily. At least one of the first arm device 3R and the second arm device 3L has a main arm 32 protruding in a direction, a sub arm 33 protruding along the main arm 32 and capable of cooperating with the main arm 32 to hold the material, a pressure contact device 90 for establishing a pressure contact between a part of a protrusion edge 33*f* of the sub arm 33 with a protrusion edge 32*f* of the main arm 32 while defining a clearance 92 between a base end portion 32*r* of the main arm 32 and a base end portion 33*r* of the sub arm 33, the pressure contact between making it possible to hold the material temporarily, and a clearance reduction device 91 for enhancing a degree of holding the material by engaging one of the main arm 32 and the sub arm 33 to the other.

6 Claims, 7 Drawing Sheets

SEWING MATERIAL HOLDING DEVICE AND SEWING MACHINE HAVING THE SAME

CROSS REFERENCE TO RELATED APPLICATIONS

The present application is based on Japanese patent application no. 2000-072925, filed on Mar. 15, 2000, which is hereby incorporated by reference in its entirety.

BACKGROUND OF THE INVENTION

1. Field of the Invention

This invention relates to a sewing material supporting device, and a sewing machine having the same.

2. Discussion of the Background

Japanese Patent Laid-open Publication No. 2000-42276 discloses a sewing material holding device. This sewing material holding device includes a stationary main arm which extends in one direction, a movable auxiliary arm pivoted to the main arm and extending in the one direction, an urging member which urges the movable auxiliary arm for closing the same and an engaging portion provided on the movable auxiliary arm and maintaining, when operated, an open condition of the movable auxiliary arm. In this sewing material holding device, before a sewing material is held between the main arm and the movable auxiliary arm, a wide gap or clearance is defined therebetween. And when the engaging portion is released, the urging member causes the movable auxiliary arm to rotate to close the gap, thereby clamping or holding the sewing material between the arms.

Japanese Patent Laid-open Print No. Hei. 7(1995)-305257 discloses a rectangular tambour on which a fabric to be embroidered is mounted is tensioned. The mounted condition of the fabric on the tambour is maintained by a pair of clamp devices.

Japanese Patent Laid-open Print No. Hei.8(1996)-41774 discloses a rectangular tambour on which a sewing material is mounted in tension and which has a pair of opposed recesses. For holding the sewing material on the tambour, another frame is used whose projections fit into the recesses of the tambour via the sewing material.

In Japanese Patent Laid-open Publication No. 2000-42276, for clamping the sewing material between the main arm and the movable auxiliary arm, the movable auxiliary arm has to be rotated by the urging force of the urging member, toward the main arm by releasing the engaging portion. Due to the fact that a large gap is formed between the main arm and the movable auxiliary arm before the clamping is done, the user has to hold the sewing material until completion of the clamping. Such temporary holding of the sewing material is very cumbersome.

In Japanese Patent Laid-open Print No. Hei. 7(1995)-305257, the fabric which is in tension on the tambour is clamped by the clamp devices. Thus, it is also very cumbersome to hold the fabric until the clamping is completed.

In Japanese Patent Laid-open Print No. Hei.8(1996)-41774, holding the sewing material on the tambour is done by male-and-female engagement between the tambour and the frame. Until such engagement is completed, the sewing material has to be held on the tambour temporally until the male-and-female engagement is completed.

A need exists to provide, for overcoming the aforementioned problems, a sewing material holding device and/or a sewing machine having such a holding device.

SUMMARY OF THE INVENTION

Accordingly, a first aspect of the present invention is to provide a sewing machine which comprises a sewing machine main body including a sewing mechanism, and a material holding device mounted on the sewing main body and having a first arm device and a second arm device between which a material is detachably held for being sewn by the sewing mechanism. At least one of the first arm device and the second arm device of the holding device includes a main arm protruding in a direction. A sub arm protrudes along the main arm and is capable of cooperating with the main arm to hold the material. A pressure contact part establishes pressure contact between a part of a protrusion edge of the sub arm with a protrusion edge of the main arm with defining a clearance between a base end portion of the main arm and a base end portion of the sub arm, the pressure contact between making it possible to hold the material temporarily. A clearance reduction device enhances a degree of holding the material by engaging one of the main and sub arms to the other.

A second aspect of the present invention is to provided a sewing machine of the first aspect, wherein at least of at least one of the first arm device and the second arm device of the material holding device includes a sewing material guide portion for guiding and putting the material between the main arm and the sub arm.

A third aspect of the present invention is to provide a sewing machine of any one of the first aspect and the second aspect, wherein the material holding device includes a long plate guide holding portion extending is a direction of intersect with the direction along which the main arm extends, at least one of the first arm device and the second arm device being slidably mounted on the long plate guide holding portion such that a clearance between the first arm device and the second arm device is made continually variable.

A fourth aspect of the present invention is to provide a material holding device mounted on a sewing machine, which comprises a first arm device and a second arm device between which a material is detachably held for being sewn by a sewing mechanism of the sewing machine, at least one of the first arm device and the second arm device of the holding device including a main arm protruding in a direction. A sub arm protrudes along the main arm and is capable of being coping with the main arm to hold the material. A pressure contact part establishes pressure contact between a part of a protrusion edge of the sub arm with a protrusion edge of the main arm with defining a clearance between a base end portion of the main arm and a base end portion of the sub arm, the pressure contact making it possible to hold the material temporarily. A clearance reduction device enhances a degree of holding of the material by engaging one of the main and sub arms to the other.

In accordance with the present invention the pressure contact part establishes pressure contact between the protrusion edge of the sub arm and the protrusion edge of the main arm while a clearance is defined between the base end of the main arm and the base end of the sub arm. Such pressure contact makes it possible to temporarily hold the sewing material. Since the sewing material is temporarily held by the pressure contact, the operator does not need to hold the sewing material.

In addition, the clearance makes the contact area between the main arm and the sub arm smaller, which makes it possible to move the sewing material, along the clearance defined between the main and sub arms to the formal holding position. Upon completion of the movement or transfer of the sewing material to its formal holding position, the clearance reduction device reduces the clearance, resulting in the main and sub arms approaching one another, thereby increasing the degree for holding the sewing material. Thus, holding or clamping the sewing material at the formal holding position is established.

The sewing material in accordance with the present invention and the holding device in accordance with the present invention can employ the following concepts. At least one of the first and second arm devices can have a guide portion which makes it possible to feed the sewing material between the main and the sub arms. Such a guide portion can form a slant surface which constitutes the clearance between the main and sub arms. The guide portion can be positioned at least at one of the protrusion edges of the respective main and sub arms.

At least one of the opposed holding surfaces of the respective main and sub arms can have high frictional resistance for enhancing the temporary and formal holding abilities. In this case at least one of the opposed holding surfaces of the respective main and sub arms is preferably has a high frictional property, i.e., it is formed of a high friction coefficient material such as rubber or is formed to have fine concave portions (or convex portions) such as a knurled surface for ensuring the holding of the sewing material.

At least one of the opposed holding surfaces of the respective main and sub arms preferably has a feature for enhancing the temporary and formal holding ability of the sewing material. Such a feature may be a convex or concave surface structure.

The material holding device can be incorporated into the sewing machine upon its assembly or can be added later to a commercial sewing machine. Whether or not the sewing machine has an embroidering function is irrelevant.

At least one of the first arm device and the second arm device preferably has a contact avoiding device which prevents contact between the clearance reduction part and the sewing material. As such a contact avoid means, a projection acting as a stopper is available. The contact avoiding device can be on at least one of the main and sub arms.

In the sewing machine in accordance with the present invention, the sewing mechanism can be of a well-known structure so long as the sewing material can be sewn while clamped or held between the first and second arm devices. Whether or not the sewing mechanism has an embroidering function is not important. Any sewing machine, whether it is designed for industrial use or domestic use, is available.

The first and second arm devices are preferred to be independent from each other and be placed in parallel to each other.

The material holding device can be a long guide holding portion which extends across the protruding direction of the main arm and on which at least one of the first arm device and the second arm device are slidably mounted so that the distance between the first arm device and the second arm device is made variable in a stepless fashion. In this case, only one of the first arm device and the second arm device is movable, or both are movable.

If one of the first arm device and the second arm device is made movable, the long guide holding portion is preferred to have an arm position indicator for recognizing the frequently used arm device. Employing such a concept, positioning one of the first and second arm devices can be done quickly. Preferably, the arm position indicator is in the form of at least one of a visible indication which makes it possible to recognize the frequently used slide position with the naked eye, audible indication which makes it possible to recognize the frequently used slide position by the ear, and touch indication which makes it possible to recognize the frequently used slide position by touch. Of course, at least two of these three forms can be employed, i.e., both visible indication and audible indication, both audible indication and touch indication, or both visible indication and touch indication.

In the case where at least one of the first and second arm devices is movable, the movable distance can be set to be ¼–5 times, or ⅓–3 times, the length of the movable arm device. However, such dimensions are not limiting.

BRIEF DESCRIPTION OF THE DRAWINGS

A more complete appreciation of the invention and other advantages thereof will be readily obtained as the same becomes better understood by reference to the following detailed description when considered in connection with the accompanying drawings, wherein.

DETAILED DESCRIPTION OF THE PREFERRED EMBODIMENTS

[FIRST EMBODIMENT]

Herein below, a first embodiment of the present invention will be described with reference to FIGS. 1 to 8 inclusive.

Figure 1:
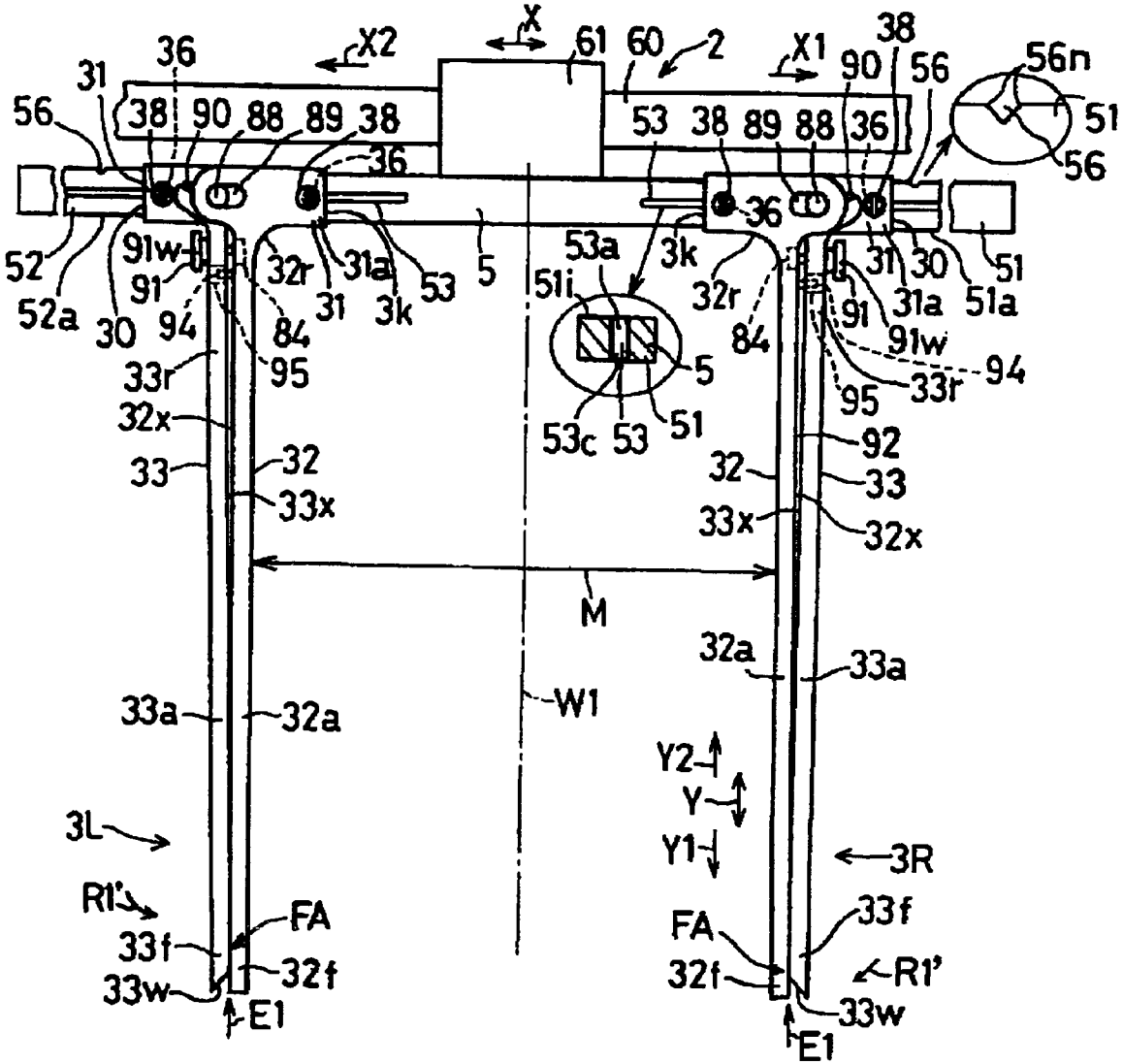
FIG. 1 shows a plan view of a substantial part of a holding device for sewing material according to a first embodiment of the present invention.

FIG. 1 shows a main part of a sewing material holding device 2. The holding device 2 can be mounted on a sewing machine during its assembly or added to a commercially available sewing machine. As shown in FIG. 1, the holding device 2 has a movable first arm device 3R, a movable second arm device 3L, and a long guide holding portion 5 attaching the holding device 2. The first arm device 3R extends along a direction Y1 and is made to detachably hold or clamp a part of a sewing material 1. The second arm device 3L extends along the direction Y1 and is made to detachably hold or clamp a part of a sewing material 1.

The long guide holding portion 5 is in the form of a rail and extends along a direction (E.g., orthogonal direction) X (X1/X2 direction) orthogonal to the extension direction of the first arm device 3R and the second arm device 3L. By the way, in this specification the extension direction of the first arm device is defined as Y1 direction, and the intersecting direction (orthogonal direction) to the extension direction of first arm device 3R and the second arm device 3L is defined as the X direction (X1/X2 direction).

A guide rail 60 is positioned is parallel with the long guide holding portion 5. The guide rail 60 extends horizontally and along the direction X (X1/X2 direction). The guide rail 60 is mounted and driven to be able to move back and forward in the Y direction (Y1/Y2 direction) by a drive structure (which is driven by a motor, not shown) on the sewing machine shown in FIG. 12. The guide rail 60 is constructed to be able to stop at optional positions along Y direction.

A movable portion 61 is mounted on the guide rail and is connected with an X drive structure (not shown) on the sewing machine. The X drive structure has a endless timing belt connected with the movable portion 61 and a source of the X drive (generally a motor being used) to actuate the timing belt. By driving the source for drive at the X drive structure, the timing belt will revolve and the movable portion 61 can move on the guide rail 60 along the X direction (X1/X2 direction). The movable portion 61 is able to stop at an optional position along the X direction. The long guide holding portion 5 is mounted to be unitary with the movable portion 61. Therefore if the movable portion 61 moves along the X direction (X1/X2 directions) the long guide holding portion 5 also moves along the X direction.

The shape of a horizontal section of the long guide holding portion 5 is a long rectangular shape elongated in the Y direction. As shown in FIG. 1, the long guide holding portion 5 has the first long guide portion 51 extended in the X1 direction and the second long guide holding portion 52 extended in the X2 direction. Consequently the first long guide holding portion 51 and the second long guide holding portion 52 are positioned mutually back to back.

As shown in FIG. 1, a slot 53 extends along the length of the first long guide holding portion 51. The slot 53 goes through the thickness of the first long guide holding portion, to define a top surface aperture 53*a* and bottom surface aperture 53*c*. These apertures 53*a* and 53*c* extend along the length of the long guide portion 51.

Figure 2:
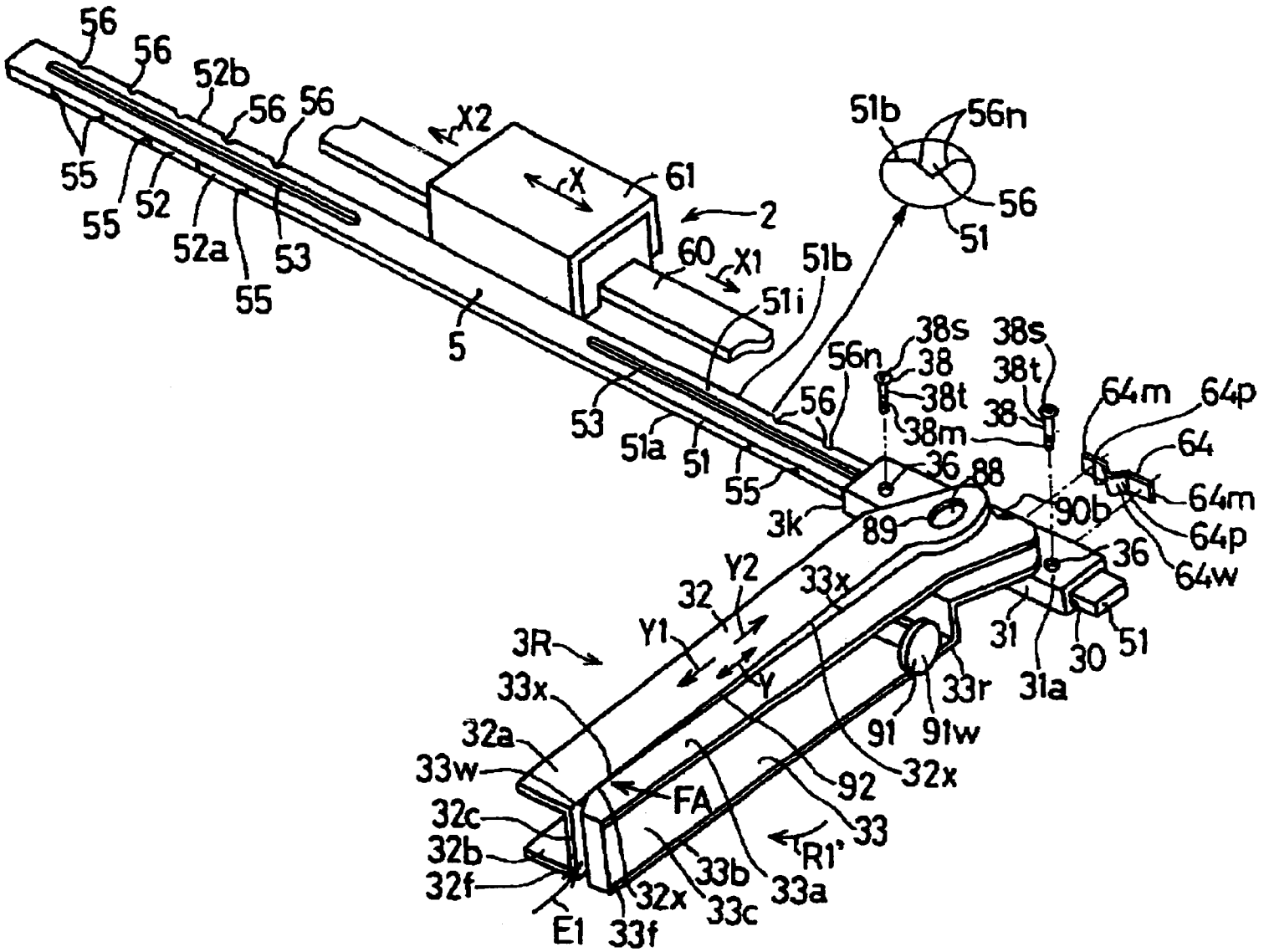
FIG. 2 shows an exploded perspective view of a part of the substantial part shown in FIG. 1.

As shown in FIG. 2, on the front surface of 51*a* visible to an operator, a plurality of marks 55 are provided at a predetermined spacing. The marks 55 are used to discriminate the position of first arm device 3R. On the back surface 51*b* of the first long guide holding portion 51 multiple detents are provided at the predetermined spacings. Each detent 56 is a triangular groove in cross section, which has right and left planar surfaces 56*n* (like an isosceles triangle). The detents 56 insure that the first arm device 3R are correctly positioned, and functional to also discriminate a position of a second arm.

As shown in FIG. 2, the first arm device 3R has an oblong box type base 31 which has a through hole 30, a main arm 32 united with the base 31 and extending horizontally in the Y1 direction from the base 31, and a swing type sub arm 33 extended horizontally along the Y1 direction. The main arm 32 has top wall portion 32*a*, bottom wall portion 32*b* and a holding wall portion 32*c*, to form a horseshoe cross-section. The holding wall portion 32*c* of the main arm 32 has a surface 32*x*, which may be made of an adhering material, with a high coefficient of friction and can contact a sewing material 1 sub-arm 33 which is independent of the main arm 32 and is a unit separate of the main arm 32. The sub-arm 33 face opposite the main arm 32, and has a top wall portion 33*a*, a bottom wall portion 33*b* and a holding wall portion 33*c*, to provide a horseshoe-like cross section, and a disposing surface 33*x* which is made of adhering a material of high coefficient of friction to hold the sewing material 1. By the way, the disposing surfaces 32*x* and 33*x* are in mutually opposite facing positions.

As shown in FIG. 2, at the protrusion position 33*f* of sub-arm 33 there is provided a sewing material guide portion 33*w* which is composed by a tapered surface declining to enlarge the width of clearance towards the cutting edge. Accordingly it becomes easy to push the sewing material 1 into the clearance between the disposing surface 32*x* of the main arm 32 and the disposing surface 33*x* of the sub-arm 33 along the direction E1.

Figure 3:
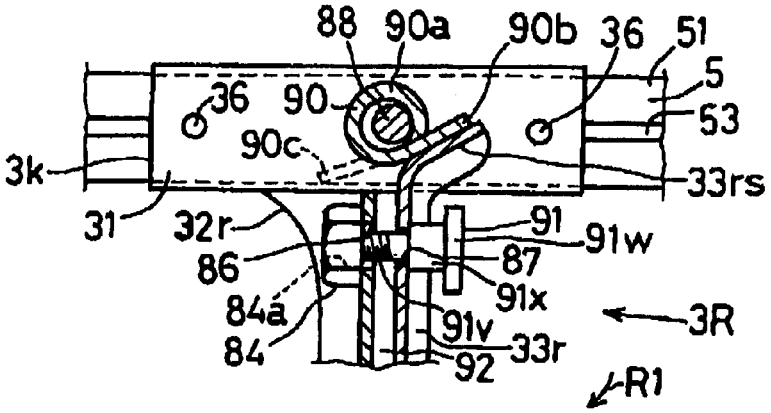
FIG. 3 shows a cross-section view of a vicinity of a first arm of the sewing material holding device according to the first embodiment of the present invention.

As shown in FIG. 3, on the base end portion 32*r* of the main arm 32 are provided a nut 84 having a threaded hole 84*a* and a hole 86 facing opposite the threaded hole 84*a*. A hole 87 in the base end portion 33*r* of the sub-arm 33 faces the threaded hole 84*a*.

Figure 4:
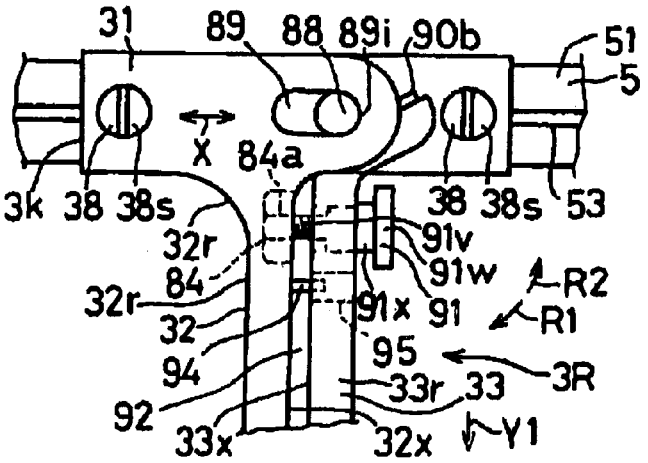
FIG. 4 shows a plan view of the vicinity of the first arm of the sewing material holding device, when in its initial state, according to the first embodiment of the present invention.

As shown in FIG. 4, a supporting axle 88 of the sub-arm 33 is inserted into a guide hole 89 made in base end portion 32*r* of a main arm 32. The sub-arm 33 can thereby swing in the R1/R2 direction relative to the main arm 32. The guide hole 89 is a slot extended along the X direction. The supporting axle 88 can move along X direction in the guide hole 89.

As shown in FIG. 3, the first arm device 3R has a spring 90 functioned as a means of connection with pressure, and a clearance adjusting bolt 91 functioned as a means of clearance decrease. The clearance adjusting bolt 91 has an enlarged end 91*w* which can be rotated from outside of sub-arm 33 by an operator, and a screw portion 91*x* having a male screw 91*v* able to be threaded into threaded hole 84*a* for connection to the main arm 32.

The S-spring 90 is located between the main arm 32 and the sub-arm 33. As shown in FIG. 3, the spring 90 has a coil member 90*a* having a vertical center axial line, a spring edge portion 90*b* extended from coil member 90*a*, and another spring edge portion 90*c* extended from coil member 90*a*. As shown in FIG. 3, the spring edge portion 90*b* abuts a bent portion 33*rs* of a base end portion 33*r* on sub-arm 33. The other spring edge portion 90*c* abuts the base portion 31. By a spring force of the spring 90, as shown in FIG. 1, the projection edge part 33*f* of sub-arm 33 is applied with force toward the direction of R1, namely toward the projection edge part of 32*f* of main arm 32. By this application of the force, the projection point 33*f* of sub-arm 33 is pressed onto the projection point 32*f* of the main arm 32 with pressure. Namely the projection point 33*f* of the sub-arm 33 is pressed onto the projection point 32*f* of main arm 32 with pressure FA.

As shown in FIG. 1, the clearance 92 becomes narrow between the projection point 32*f* of main arm 32 and projection point 33*f* of sub-arm, and becomes wider between the base end portion 32*r* of the main arm 32 and base end portion 33*r* of the sub-arm. The clearance 92 has a flat triangular shape closing the side of projection point 33*f*. In this way, by keeping a projection point 33*f* of sub-arm 33 in contact with a projection point 32*f* of main arm 32 with pressure, a sewing material 1 is easily disposed between a projection point 32*f* of main arm 32 and a projection point 33*f* of sub-arm 33.

Figure 5:
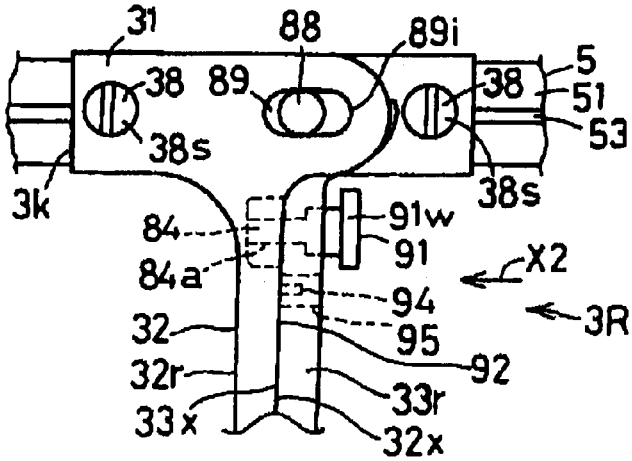
FIG. 5 shows a plan view of the vicinity of the first arm of the sewing material holding device, when in its clamping state, according to the first embodiment of the present invention.
Figure 6:
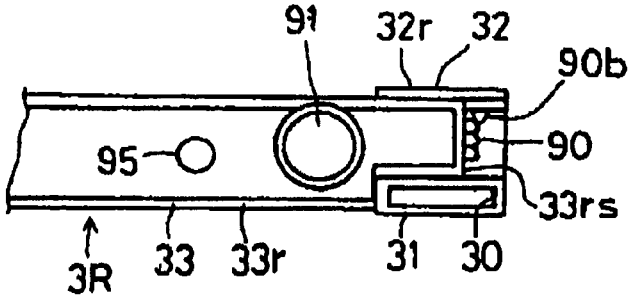
FIG. 6 shows a lateral view of the vicinity of the first arm of the sewing material holding device according to the first embodiment of the present invention.

In normal conditions, as may be understandable from FIG. 3, supporting axle 88 is positioned at one edge 89*i* of a guide hole 89 by a pressing force of the spring 90. When inserting the clearance adjusting bolt 91 through holes 86 and 87 of the sub-arm 33, upon tightening the clearance adjusting bolt 91 on the nut 84, as shown in FIG. 5, the supporting point axle 88 moves along guide hole 89 along the direction X2, and the sub-arm 33 also moves in a direction of X2. Accordingly, as shown in FIG. 5, the base end part 33*r* of sub-arm 33 moves close to the base end part 32*r* of main arm 32 as to decrease the clearance 92. The clearance adjusting bolt 91 therefore performs a clearance decreasing function.

When the sub-arm 33 approaches the main arm 32 as the projection point 33*f* of sub-arm 33 is contacted with pressure to the projection point 32*f* of the main arm 32 by spring 90, the major part of sub-arm 33 comes to contact with the main arm 32. Namely the contacting area of the disposing surface 32*x* of the main arm 32 and the disposing surface 33*x* of the sub-arm 33 increases. By the above movement, the disposing force between the main arm 32 and the sub-arm 33 is secured, and the disposing surface 32*x* of the main arm 32 and disposing surface 33*x* of the sub-arm 33 can hold a sewing material firmly with clamping in the direction of its thickness.

As shown in FIG. 4 or 5, a stopper 94 is set in the base end part 32*r* of the main arm 32 at a position closer to the projection point 32*f* than is the clearance adjusting bolt 91, and the sub-arm 33 has an idle hole for preventing interference of stopper 94 and sub-arm 33 when main arm 32 and sub-arm 33 come close together. The stopper 94 therefore prevents contact of the sewing material 1 with the clearance adjusting bolt 91.

As it is understandable from FIG. 2, the through hole 30 of the first arm device 3R, being matched with a cross section shape of first long guide holding portion 51, will be provided on the first long guide holding portion 51, and can slide along the length of the first long guide holding portion 51.

Figure 8:
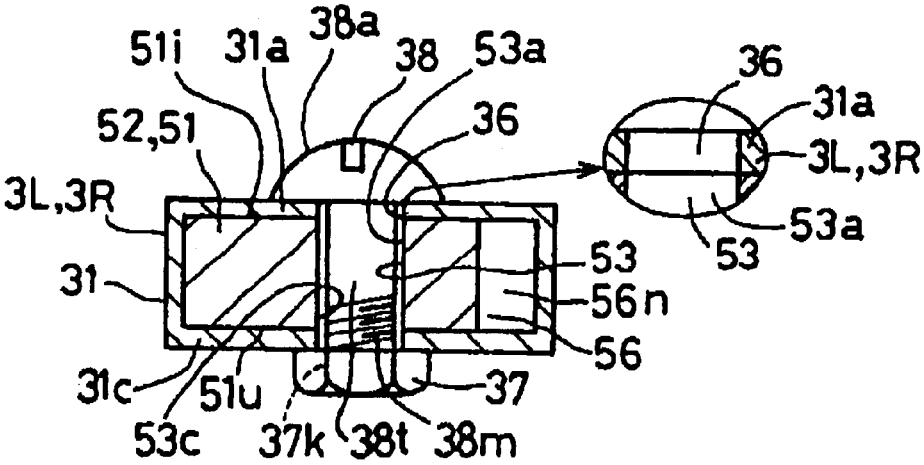
FIG. 8 shows a cross-sectional view of a configuration for securing the first and second arms devices to a holding guide portion in the sewing material holding device according to the first embodiment of the present invention.

FIG. 8 shows a section of the first arm device 3*r* and a long guide holding portion 5. As shown in FIG. 8, at the top surface wall 31*a* of base part 31 of the first arm device 3R a number of fixation holes 36 are provided for fastening the first arm device 3R on a long guide holding portion. Each arm fixation hole 36 has a round shape and goes through the top surface wall 31*a* of base portion 31. However, the inside wall of arm fixation hole 36 is not threaded. As shown in FIG. 8, at the bottom surface wall 31*c* of the first arm device 3R is a fixation element 37. This fixation element 37 is a nut 37*k* welded to the bottom surface wall 31*c* of first arm device 3R. However, it may be permitted to be a tubular wall by burring proofing. The arm fixation hole 36 of first arm device faces opposite the slot 53 of a long guide holding portion 5. Accordingly even if the base portion 31 of first arm device slides along the first long guide holding portion 51 in the direction X1/X2, the arm fixation hole 36 of first arm device 3R can face a slot 53 of the first long guide holding part 51.

As shown in FIG. 8, an arm fixation screw 38 extends through the arm fixation hole 36 of the first arm device 3R from the upper side of the first arm device 3R. As shown in FIG. 8, an arm fixation screw 38 has a screw shaft 38*t* having a male screw 38*m* and a head 38*s* connected with one end of screw shaft 38*t*. A screw thread 38*m* of screw shaft 38*t* is threaded to nut 37*k*.

As it is understandable from FIG. 8, if an operator rotates head 38*s* of arm fixation screw 38 using a tool, the thread 38*m* of screw shaft 38*t* mates with a nut 37*k*. As a result the distance between fixation article 37 and head 38*s* of arm fixation screw 38 is shortened, and the top surface wall 31*a* of base part 31 of first arm device 3R contacts the top surface 51 of the first long guide holding portion 51 with pressure, and also the bottom surface wall 31*c* of base part 31 of first arm device 3R contacts with a bottom surface 51*u* of first long guide holding portion 51 with pressure. Consequently the first arm device 3R is fastened without sliding to the first long guide holding portion 51.

In order to make the first arm device slide, an operator may loosen arm fixation screw 38. By this action, a screw threading 38*m* of screw shaft 38*t* is rotated within nut 37, the contact by pressure will be loosened, and the first arm device 3R can slide along the first long guide holding portion 51.

Figure 7:
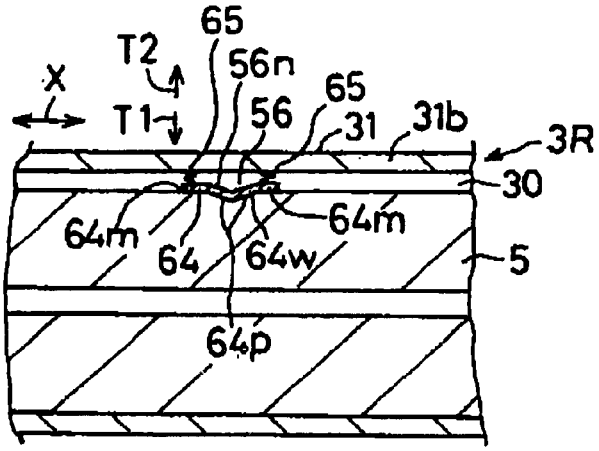
FIG. 7 shows a cross-sectional view of a vicinity of a device for discrimination of arm position of the sewing material holding device according to the first embodiment of the present invention.

As shown is FIG. 7, an arm connecting clamp 64 is provided at the back surface wall 31*b* of the base portion 31 of the first arm device 3R. The arm connecting clamp is made of plastic or sheet metal, and has a flat plate portion 64*m* and a connecting protrusion 64*w* combined with the flat plate portion 64*m*. The connecting protrusion 64*w* has a triangular shape (concretely, isosceles triangular shape) having an inclined plane 64*p* with equal right and left hand sides.

As shown in FIG. 7, the connecting protrusion 64*w* of an arum connecting clamp 64 protrudes at an empty space of slide hole 37 of the base portion 31, the arm connecting clamp 64 is held by a spring 65 of the connecting member with pressure at a first base portion 31 of the first arm device 3R. The spring 65 applies a force to connect the arm connecting clamp 64 in the T1 direction shown by an arrow, namely toward a long guide holding portion 5. The connecting protrusion 64*w* of an arm connecting clamp 64 can connect and release with each point of the multiple detents 56 made on the first long guide holding portion 51.

Namely, when the first arm device 3R slides in the X direction, the connecting protrusion 64*w*, being contacted with pressure toward the T1 direction by the spring 65, is inserted into a shallow detent 56 at the first long guide holding portion 51. This is recognized as a tactile impression by an operator, which functions as a means for discrimination of tactile impression.

When the first arm device 3R slides further in the X direction, as is understood from FIG. 7, an inclined plane 64*p* of the arm connecting clamp 64 climbs up an inclined plane 56*n* of the detent 56, and the connection between a protrusion shape of the connecting protrusion 64*w* and the detent 56 will be canceled.

When the connecting protrusion 64*w* of the arm connecting clamp 64 is connected with any of the detents 56, as an external force is required to make the first arm device slide in the X direction, unnecessary vibrations of the first arm device 3R will be brought under control. Accordingly the arm connecting clamp 64 and the detent 56 act as a means to inhibit unnecessary of the first arm device 3R.

In this embodiment of the present invention, as shown in FIG. 1, the second arm device 3L has the same structure as first arm device 3R, and is symmetrical relative to a virtual center line W1 of a moving part 61 in the direction X. Concerning to the second long guide holding portion 52 and the first long guide holding portion 51 the structure is a symmetrical structure relative to the virtual center line W1 of a moving part 61.

Namely as shown in FIG. 1, the second arm device 3L has a base portion 31 having a through hole along the X direction, a main arm 32 extending from the base portion 31 along the Y1 direction, a sub-arm 33 extending toward the Y1 direction. In the second arm device, sub-arm 33 is a separate unit from the main arm 32. As shown in FIG. 1, on the second arm device 3L a supporting axle 88 fits into a guide hole 89 on a base portion 32*r* of the main arm 32, and can move in the direction of the major axis of the guide hole 89. Furthermore, as shown in FIG. 1, the second arm device 3L has a spring for connection with pressure, and a clearance adjusting bolt 91 as a means of clearance decrease.

As shown in FIG. 2, a slot 53 extends on the top surface of the second long guide holding portion 52. A mark 55 which functions as a means of position discrimination is provided at multiple points in predetermined intervals on a front surface 52*a* of the second long guide holding portion 52. The marks 55 can distinguish positions of high frequency use of the second arm device 3L. Multiple detents 56 are made in predetermined interval at the back surface 52*b* of the second long guide holding portion 52.

As shown in FIG. 1, an arm fixation hole 36 facing opposite the slot 53 is made on the top surface wall 31*a* on the base portion of the second arm device 3L. An arm fixation screw 38 extends through the arm fixation hole 36 of the second arm device 3L from above the second arm device 3L.

Figure 9:
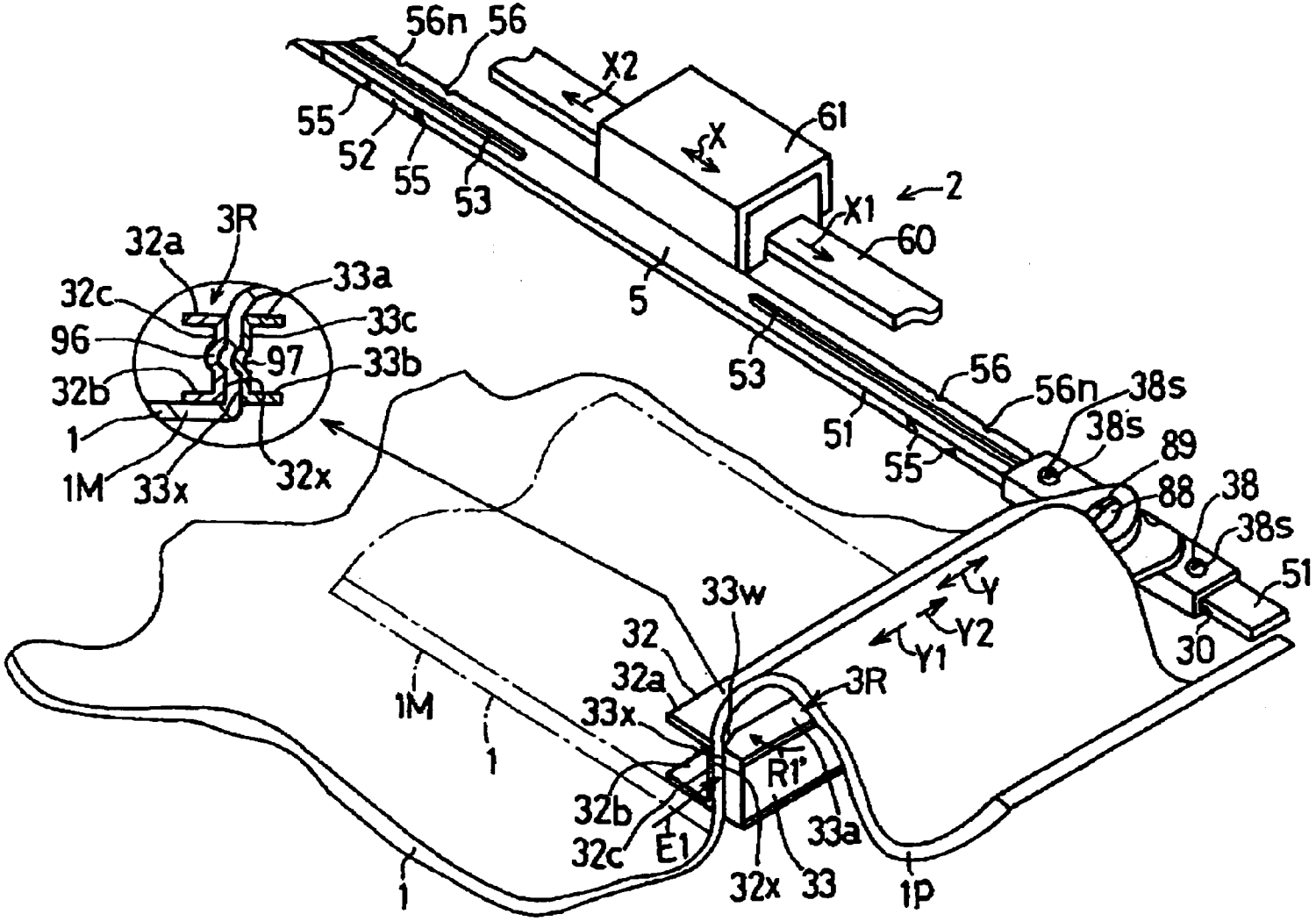
FIG. 9 shows a perspective view illustrating how sewing material is clamped by the sewing material holding device according to the first embodiment of the present invention.

When a sewing operation such as embroidering is carried out, as shown in a solid lines in FIG. 9, from the sewing material guide portion 33*w* the sewing material 1 is inserted in a direction of E1 along a clearance between the disposing surface 32*x* at main arm 32 of the first arm device 3R and the disposing surface 33*x* of the sub-arm 33, until it reaches the front of stopper 94.

After that, an operator rotates the head portion 91*w* of the clearance adjusting bolt and make the disposing surface 33*x* of the sub-arm 33 engage the disposing surface 32*x* of main arm 32 by tightening the clearance adjusting bolt 91 onto the nut 84. Although not shown in the figures, the same operation is repeated for the second arm device 3L.

When sewing a material, such as embroidering, a clearance M between the first arm device 3R and second arm device 3L is adjusted accordingly with a size of sewing material 1. In this embodiment of the present invention, by loosening an arm fixation screw 38 of the first arm device 3R and second arm device 3L, either of the first arm device 3R or second arm device 3L can slide on the long guide holding portion 5. An operator then slides either one, or both, of the first arm device 3R or second arm device 3L by hand in a direction of X1 or X2 along the long guide holding portion 5. In this way the position of the first arm device 3R and second arm device 3L in a direction X corresponds to the size of the sewing material 1.

After the position of first arm device 3R and second arm device 3L are set, the first arm device 3R and second arm device 3L can be fixed to long guide holding portion 5 by tightening the arm fixation screw 38 onto the nut 37*k*.

Figure 12:
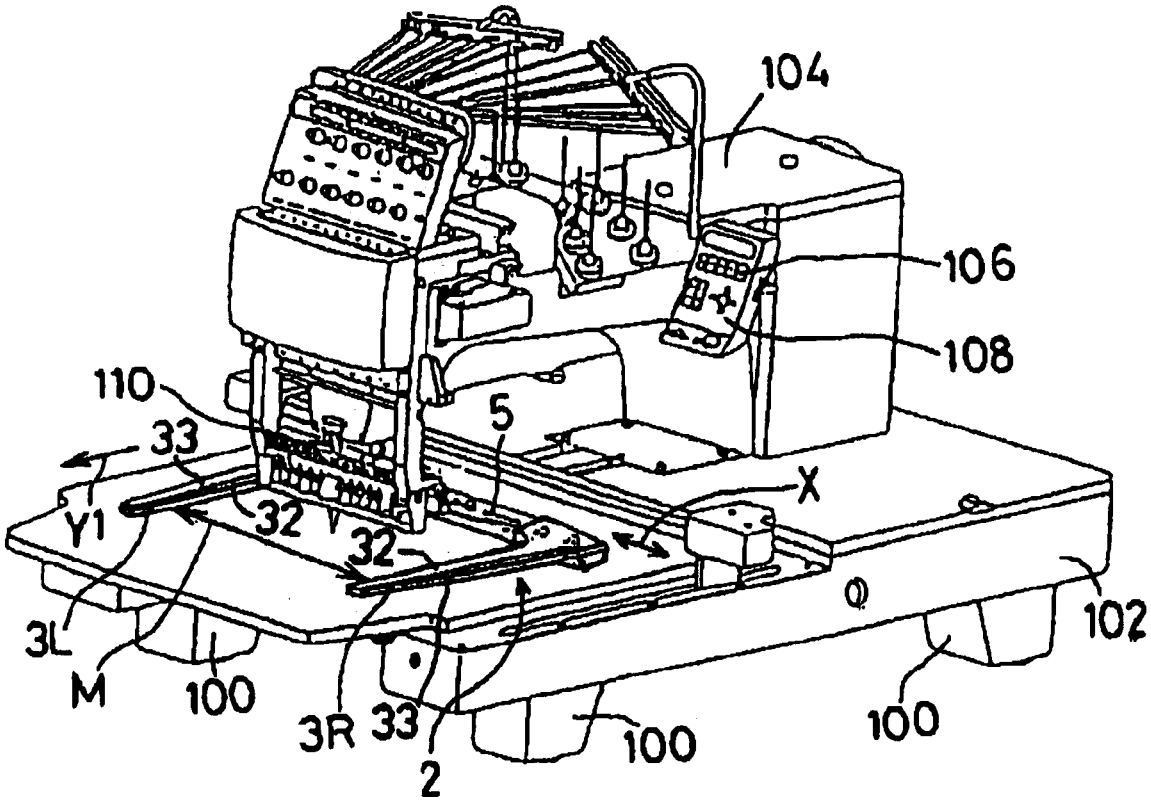
FIG. 12 shows a perspective view of sewing machine.

If the clearance M between the first arm device 3R and the second arm device 3L is broadened, the sewing material 1 will be tensioned. Then, the sewing machine as illustrated in FIG. 12 shall be operated to sew or embroidery. Since the sewing material is tensioned, the sewing operation will be conducted in good order.

Furthermore, as it can be understood from FIG. 9, when the sewing material is tensioned, the portion 1M of the sewing material 1 between the first arm device 3R and second arm device 3L is located at a position lower than a lower wall portion 32*b* of main arm 32. The part IP of the sewing material outside of the first arm device 3R is located at higher than an upper wall portion 33*a* of the sub-arm 33.

When sewing such a material, when it becomes necessary to slide the sewing material 1 in the X or Y directions, a controller causes the guide rail 60 to move for Y direction movement, or the moving portion 61 to be moved along the guide rail 60 for X direction movement. If the moving portion 61 is moved by the controller toward a direction of X1 and X2 along the guide rail 60, the long guide holding portion 5 held by the moving portion 61, the first arm device 3R and second arm device 3L also move along the direction X (X1/X2 direction).

As above explained, by this embodiment of the present invention, as can be understood from FIG. 1, before a normal state of holding the sewing material, while keeping a clearance 92 between a base end portion 32*r* of the main arm 32 and a base end portion 33*r* of the sub arm 33 on the first arm device 3R and second arm device 3L, a projection portion 33*f* of the sub-arm 33 is contacted with pressure to a projection portion 32*f* of main arm 32, by point contact. Accordingly if the sewing material 1 is inserted between the main arm 32 and the sub-arm 33 of the first arm device 3R before the sewing material is held firmly, the sewing material is easily held temporarily in a direction of its thickness by the point contact of projection portion 32*f* of main arm 32 and projection portion 33*f* of sub-arm 33. Therefore it is not necessary to hold the sewing material 1 by an operator's hands.

As a clearance 92 is provided between a base end portion 32*r* of the main arm 32 and a base end portion 33*r* of the sub-arm 33, the movement resistance against the sewing material 1 is reduced.

Therefore by holding the sewing material tentatively, as written in the above, the sewing material 1 can be moved easily to the primary holding position. After the sewing material is moved to the right position, the clearance 92 is reduced by making the base end 33*r* of the sub-arm 33 approach the base end portion 32*r* of the main arm 32 by screwing the clearance adjusting bolt 91 into the fixation nut 84, and the sewing material can be hold with clamping between the disposing surface 32*x* of main arm 32 and the disposing surface 33*x* of the sub-arm 33.

Furthermore as shown in FIG. 9, provided at the disposing surface 32*x* of the main arm 32 is a first sewing material engagement portion 96 (one piece or multiple pieces) in a shape of shallow dent, and also provided at the disposing surface 33*x* of sub-arm 33 is the second sewing material engagement portion 97 (one piece or multiple pieces in a shape of convexity. By these structures a holding force of the sewing material is further strengthened.

And in this embodiment of the present invention, as a sewing material guide portion 33*w* is provided on the first arm device 3R and second arm device 3L of the sewing material holding device 2, when held tentatively, the sewing material can be smoothly pushed in a direction E1 between the main arm 32 and the sub-arm 33.

The distance M between the first arm device 3R and the second arm device 3L may be adjusted as corresponding to a size of the sewing material 1. In this embodiment of the present invention, a distance M between the first arm device 3R and second arm device 3L can be made continuously variable by sliding the first arm device 3R and second arm device 3L along a direction X1 and X2. Accordingly it is applicable to any size of the sewing material. Furthermore as both of the first arm device 3R and the second arm device 3L are able to slide, it is further possible to cope with any size of sewing material.

In the case of embroidering work as an example of sewing, the sewing material will be extended in a state of tension by a tabaret. In the present invention, as the distance M between the first arm device 3R and the second arm device 3L is continuously variable the sewing material is kept in a condition of extension, and an embroidering work can be done without using a tabaret. Therefore a sewing machine without a tabaret and a holding device for sewing material without a tabaret are supplied to the market.

In addition to this embodiment of the present invention, multiple mark 55 showing the high frequency positions of use for the first arm device 3R and second arm device 3L are provided on the first long guide holding portion 51 and second long guide holding portion 52 as a means of arm position discrimination. As it is understood from FIG. 2 an operator can easily slide the arm devices to positions of high frequency use.

Especially in this embodiment of the present invention, as explained before, an arm connecting clamp 64 is provided on the first arm device 3R and the second arm device 3L. When the first arm device 3R and the second arm device 3L slide, the connecting protrusion 64*w* in a shape of a convexity is inserted into one of the detents 56. Therefore an operator who slides the first arm device 3R and the second arm device 3L by hand can sense when a high frequency use position is reached. In this embodiment, even if an operator does not have a will or time to examine the marks 55, the positions of high frequency use of the first arm device 3R and the second arm device 3L can be easily distinguished.

Further in this embodiment of the present invention, the connection and insertion of the connecting protrusion 64*w* in a detent 56 can be distinguished by the connecting noise. Therefore even if an operator does not have a will or time to recognize the marks 55 the positions of high frequency use of the first arm device 3R and the second arm device 3L can be easily distinguished.

The detents 56 have an isosceles triangular shape having equal inclined planes 56*a* at both right and left sides, and the connecting protrusion 64*w* of the arm connecting clamp 64 is also an isosceles triangular shape having an inclined plane 64*p* having equal right and left sides. Therefore the extent of insertion and connection when the first arm device 3R and the second arm device 3L slide toward the direction of X1 and toward the direction of X2 can be equalized.

In the case of mounting the sewing material holding device 2 on a sewing machine sold in the market, the guide rail 60 and the moving portion 61 equipped with a sewing machine can be used and it is practical to mount the long guide holding portion 5 on the moving portion 61.

Figure 10:
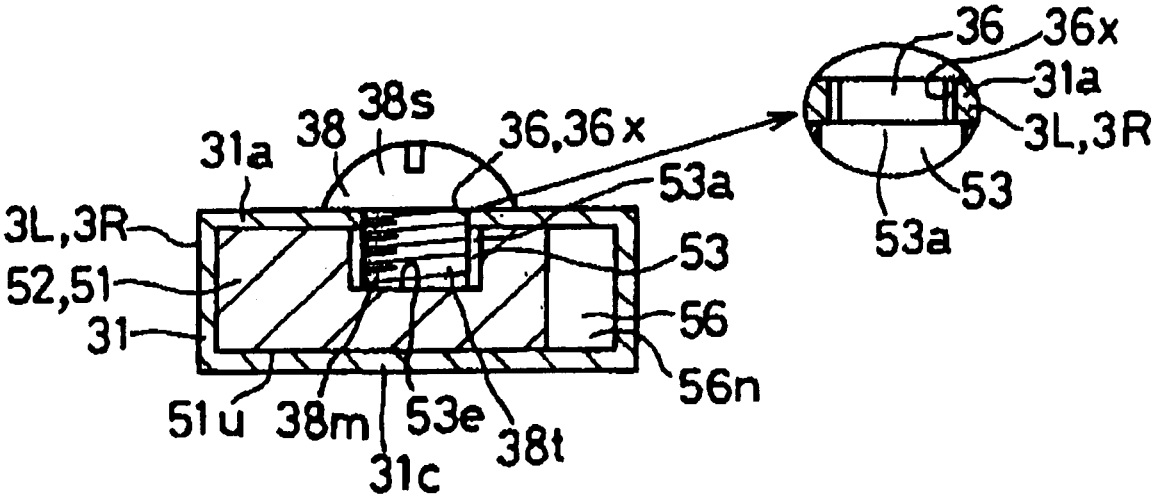
FIG. 10 shows a cross-sectional view of a configuration for securing first and second arm devices to a holding guide portion in the sewing material holding device according to a second embodiment of the present invention.

The second embodiment of the present invention is shown by referring FIG. 10. The second embodiment is composed basically by the same structure with the first embodiment, and the common parts have a common numerical number. The second embodiment has basically same advantageous effects. The different part from the first embodiment will be explained hereunder.

In the second embodiment of the present invention, the slots 53 in the first long guide holding portion 51 and second long guide holding portion 52, as shown in FIG. 10, have a top surface opening 53*a*, but do not go through to the bottom. Therefore the slots 53 have a base 53*e*. Internal threading 36*x* is provided at the inside wall surface of arm fixation hole 36 made on the top surface wall 31*a* of the first arm device 3R.

As is understood from FIG. 10, when inserting the arm fixation screw 38 in the slot 53 from above, and tightening the head 38*s* of the arm fixation screw 38 by a tool, and screwing the fixation screw 38 into the female screw 36*x* of the arm fixation hole 36, pressure is applied to the base 53*e* of the slot 53, and the bottom surface 51*u* of first long guide holding portion applies a pressure strongly to the bottom surface wall 31*c* on the base portion 31 of the first arm device 3R. As a result, the first arm device 3R is fixed to the first long guide holding portion 51, and the first arm device 3R cannot slide against the first long guide holding portion 51.

To permit the first arm device 3R to slide, the arm fixation screw 38 is loosened by using a tool to rotate the screw 38. Fixation is thereby released, as the bottom surface 51*u* of the first long guide holding portion 51 releases pressure on the bottom surface wall 31*c* of the first arm device 3R. Above explanation also applies to the second arm device 3L.

Figure 11:
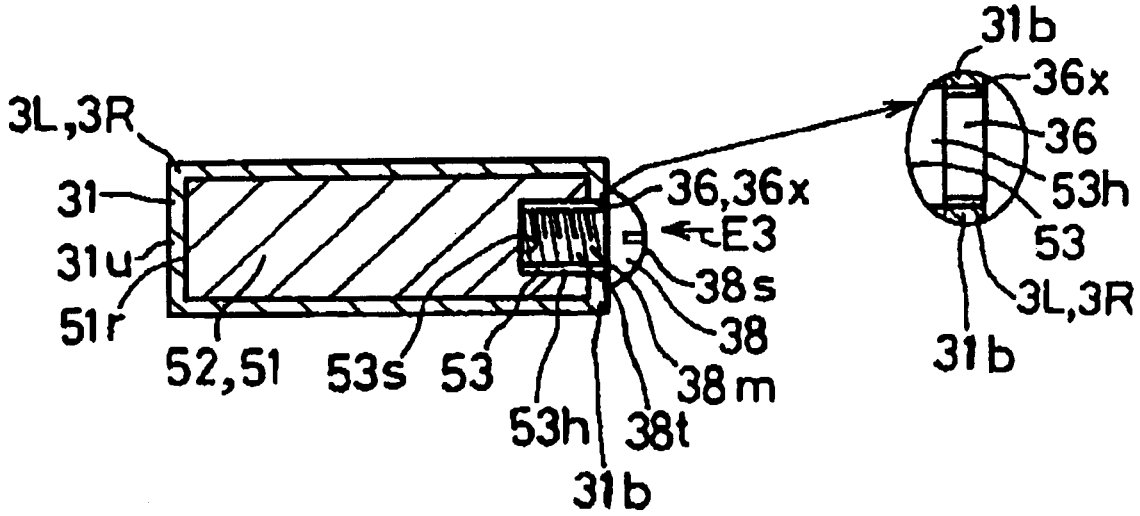
FIG. 11 shows a cross-sectional view of a configuration for securing first and second arm devices to a holding guide portion in the sewing material holding device according to a third embodiment of the present invention.

The third embodiment of the present invention is shown referring FIG. 11. The third embodiment is basically same constitution as the first embodiment, and so the common parts are given the common numerical numbers. The third embodiment has basically the same advantageous effect. The different parts from the first embodiment will be explained hereunder. In the third embodiment of the present invention, the slot 53 on the first long guide holding portion 5 is located at the back surface of the first long guide holding portion 51. Namely the slot 53 has a back side opening, and the bottom surface 53*s* faces the side.

The arm fixation hole 35 provided at the back surface wall 31*b* of the first arm device 3R passes through the back surface wall 31*b* and opens to the side, and an internal screw threading 36*x* is provided at the inside wall.

As shown in FIG. 11, when inserting the arm fixation screw 38 into the slot 53 from a side of the first long guide holding portion 51, namely from a direction of arrow mark E3, and screwing the fixation screw 38 into the female screw 36*x* of the arm fixation hole 36, pressure is applied to the base 53*e* of the slot 53, and the side surface 51*r* of first long guide holding portion applies a pressure strongly to the side surface wall 31*u* on the base portion 31 of the first arm device 3R. As a result, the first arm device 3R is fixed to the first long guide holding portion 51, and the first arm device 3R cannot slide against the first long guide holding portion 51.

To permit the first arm device 3R to slide, the arm fixation screw 38 is loosened by using a tool to rotate the screw 38. Fixation is thereby released, as the side surface 51*r* of the first long guide holding portion 51 releases pressure on the side surface wall 31*c* of the first arm device 3R. Above explanation also applies to the second arm device 3L.

FIG. 12 shows an example of application. In this example of application a base 102 has plural legs 100, a sewing mechanism 104 has a function of embroidering with a needle drive structure mounted on the base 102, an operating board 108 has various switches 106, an embroidering needle 110 and a holding device 2 to hold the sewing material 1 arm.

The holding device 2 has the first arm device 3R extending in a direction of the arrow Y1, the first arm device 3R holding a part of the sewing material, and the second arm device 3L holding a part of sewing material, and the long guide holding portion 5 provided along a direction X which intersects with an extending direction of the first arm device 3R and the second arm device 3L. The clearance M between the first arm device 3R and the second arm device 3L is infinitely variable.

In the first embodiment of the present invention, the main arm 32 is located at the inside, and the sub-arm 33 is located at the outside, as seen in the plan view of FIG. 1. However, this orientation may be reversed.

In the first embodiment of the present invention, both first arm device 3R and second arm device 3L are able to slide along the long guide holding portion 5. However, it is also possible to fix one of the first arm device 3R and the second arm device 3L.

In the first embodiment of the present invention, as shown in FIG. 9, the engagement portion 96, 97 is composed of a shallow dent on the disposing surface 32*x* of main arm 32, and a convexity on the disposing surface 33*x* of sub-arm 33. However, this may be reversed. The coil spring 90 is provided as a mean of pressure contact. However, a different coil spring, blade spring, conical spring and so forth may be used.

The clearance adjusting bolt 91 is provided as a means of clearance reduction. However, it may be possible to reduce the clearance 92 by an air-cylinder device and to positively hold the sewing material. Only one clearance adjusting bolt 91 is provided on the arm device 3R, but plural clearance adjusting bolts may also be applicable.

Plural marks 55 are provided as an arm position discrimination means on the first long guide holding portion 51 and second long guide holding portion 52. But the number of marks 55 is not limited and a single mark 55 provided on the first long guide holding portion 51 and the second long guide holding portion 52 may be applicable. Furthermore the mark 55 is not limited to a vertical line but may be a dot, triangle, number, word and so forth.

In the first embodiment of the present invention, the first long guide holding portion 51 and a slide hole 30 have a rectangular shape in cross section. However, they may have a round shape or oval shape, or any shape which can slide the first arm device 3R and second arm device 3L smoothly.

In the first embodiment of the present invention, the arm connecting clamp 64 lets an operator feel and hear when sliding the first arm device 3R or second arm device 3L reaches a frequent use position. The marks 55 on the long guide holding portion 5 are also to distinguish the position of the first arm device 3R and second arm device 3L when the sewing material is in a high frequency use position. However, it is possible to provide only the detent 56 and the arm connecting clamp 64 and eliminate the marks 55, or to provide only the marks 55 and eliminate the detent 56 and the arm connecting clamp 64. In the first embodiment of the present invention, the arm connecting clamp 64 is provided on the first arm device 3R and second arm device 3L, and the detents 56 are provided at the long guide holding portion 5. However, it may be applicable to provide the detents 56 at the first arm device 3R and second arm device 3L, and to provide the arm connecting clamp 64 on the long guide holding portion 5.

The present invention is not restricted or confined to the embodiments explained in the above and shown in the drawings. Each of the sewing machine and the sewing material holding can have a fixation portion which fixes at least either side of the first arm device and second arm device to the long plate guide holding portion, for example by using pressure contact. Alternatively, the fixation portion may use a screw on the first arm device and second arm device, by screwing in, with the screw holding either the first arm device or the second arm device to the long plate guide holding portion by pressure.

Each of the sewing machine and the sewing material holding device can be provided with a fixation portion which has a hole having internal threading at the wall of either part of the first arm device and second arm device, a screw matable with the internal threading.

Each of the sewing machine and the sewing material holding device can be provided with a box type base portion which blocks out the slide hole connected with the long plate guide holding portion with a cross section of either part of the first arm device and second arm device.

The long plate guide holding portion has a basal plain in a shape of base. By screwing in the tip portion of screw axis, a pressure is applied to the basal plain such that either part of the first arm device and second arm device makes contact with the long plate guide holding portion with pressure, to fix either part to the long plate guide holding portion.

The sewing machine and the sewing material holding device can be provided with a means of distinguishing arm position at a sliding position of the arm device, a means for distinguishing arm position with visual discrimination of which either part of the slide position at the movable type part of the first arm device and second arm device when the sewing material in high frequency use position is being used, a mean for auditory distinguishing of arm position about either part of the slide position at the movable type part of first arm device and second arm device when the sewing material in high frequency use is being used, and a mean for distinguishing arm position with by tactile impression about either part of the slide position at the movable type part of first arm device and second arm device when the sewing material in high frequency use is being used.

Each of the sewing machine and the sewing material holding device can be provided with a shallow dent and convexity portion on the long plate guide holding portion and at either part of first arm device and second arm device.

The first arm device and second arm device may be independent and substantially in parallel.

The first arm device, second arm device and the long plate guide holding portion may be in a shape of horseshoe when the distance between the first arm device and second arm device is expanded.

The sewing machine and the sewing material holding device can be provided with means for distinguishing the position by a detent in the shape of shallow dent or convexity, a mark made at the front side of the long plate guide holding portion, or a detent made at the back surface of the long plate-guide holding portion.

As it is understood from the above explanation, according to the present invention, by making a clearance between a base end portions of main arm sub arm by means of pressure contact, a part of an edge point of the sub arm is pressure contacted with an edge point of the main arm. In this condition, the sewing material will be held temporarily with the edge of the sub arm which contacts the edge point of main arm with pressure. Since the sewing material is held temporarily, an operator need not hold the sewing material by hand.

Furthermore, while the sewing material is held temporarily by the main arm and sub arm with a clearance between the base end portion of the main arm and sub arm, the sewing material can easily and smoothly be pushed into the clearance between the base end portion of the main arm and the base end portion of the sub arm. In this way the sewing material being held temporarily by the main arm and the sub arm can be easily moved to a position for sewing.

And the sewing material is permanently held, by means of clearance reduction, by having the sub arm engage the main arm in a direction for reducing the clearance between the base end portion of main arm and the base end portion of sub arm. The degree of holding the sewing material is thus raised and the force between main arm and sub arm is raised.

By sliding either the first arm device or the second arm device, the clearance between the first arm device and second arm device can be adjustable continuously to be wide, medium or narrow. So any thickness of sewing material can be sewn and embroidered.

Particularly if the clearance between the first arm device and second arm device can be adjustable, the sewing material can be easily tensioned. According the conventional tambour can be abolished and the sewing material can be sewn and embroidered without using a conventional tambour.

Having now fully described the invention, it will be apparent to one of ordinary skill in the art that many changes and modifications can be made without departing from the spirit or scope of the invention as set forth herein.

What we claim is:

1. A sewing machine comprising:

a sewing machine main body including a sewing mechanism; and a material holding device mounted on the sewing machine main body and having a first arm device and a second arm device between which a material may be detachably held for being sewn by the sewing mechanism, at least one of the first arm device and the second arm device of the holding device including a main arm projecting in a direction, a sub arm projecting along the main arm and capable of cooperating with the main arm to hold the material, a pressure contact part configured and adapted to establish pressure contact between a part of a distal end of the sub arm with a distal end of the main arm while defining a clearance between a base end portion of the main arm and a base end portion of the sub arm, and a clearance reduction device configured and adapted to enhance a degree of holding the material by engaging the main and sub arms to each other.

2. A sewing machine in accordance with claim 1, wherein at least one of the first arm device and the second arm device of the material holding device includes a sewing material guide portion adapted and configured for guiding material between the main arm and the sub arm.

3. A sewing machine in accordance with claim 1, wherein the material holding device includes a plate guide holding portion extending in a direction to intersect with the direction along which the main arm projects, at least one of the first arm device and the second arm device being slidably mounted on the long guide holding portion such that a clearance between the first arm device and the second arm device may be varied.

4. A material holding device mounted on a sewing machine comprising:

a first arm device and a second arm device between which a material may be detachably held for being sewn by a sewing mechanism, at least one of the first arm device and the second arm device of the holding device including a main area projecting in a direction, a sub arm projecting along the main arm and capable of cooperating with the main arm to hold the material, a pressure contact part configured and adapted to establish pressure contact between a part of a distal end of the sub arm with a distal end of the main arm while defining a clearance between a base end portion of the main arm and a base end portion of the sub arm, and a clearance reduction device configured and adapted to enhance a degree of holding the material by engaging the main and sub arms to each other.

5. A sewing machine comprising:

a sewing machine main body including a sewing mechanism; and a material holding device mounted on the sewing machine main body and having a first arm device and a second arm device between which a material may be detachably held for being sewn by the sewing mechanism, at least one of the first arm device and the second arm device of the holding device including a main arm projecting in a direction, a sub arm projecting along the main arm and capable of cooperating with the main arm to hold the material, pressure contact means for establishing pressure contact between a part of a distal end of the sub arm with a distal end of the main arm while defining a clearance between a base end portion of the main arm and a base end portion of the sub arm, and clearance reduction means for enhancing a degree of holding the material by engaging the main and sub arms to each other.

6. A material holding device mounted on a sewing machine comprising:

a first arm device and a second arm device between which a material may be detachably held for being sewn by a sewing mechanism, at least one of the first arm device and the second arm device of the holding device including a main area projecting in a direction, a sub arm projecting along the main arm and capable of cooperating with the main arm to hold the material, pressure contact means for establishing pressure contact between a part of a distal end of the sub arm with a distal end of the main arm while defining a clearance between a base end portion of the main arm and a base end portion of the sub arm, and clearance reduction means for enhancing a degree of holding the material by engaging the main and sub arms to each other.

* * * * *